US005755568A

United States Patent [19]

Buhler

[11] Patent Number: 5,755,568

[45] Date of Patent: May 26, 1998

[54] MULTIPLE FLAME TORCH APPARATUS

[75] Inventor: Bruce A. Buhler, Watertown, S. Dak.

[73] Assignee: Smith Equipment Manufacturing Company, LLC, Watertown, S. Dak.

[21] Appl. No.: 563,073

[22] Filed: Nov. 27, 1995

[51] Int. Cl.[6] ..... F23D 14/28

[52] U.S. Cl. ..... 431/344; 431/350; 126/271.2 C; 126/413; 432/225; 432/183

[58] Field of Search ..... 431/344, 343, 431/354, 355; 126/401, 403, 404, 413, 414, 226, 237, 238, 239, 229, 231, 227, 228, 271.2 C, 39 R; 432/225, 183

[56] References Cited

U.S. PATENT DOCUMENTS

| | | | |
|---|---|---|---|
| 532,920 | 1/1895 | Smith | 432/32 |
| 916,209 | 3/1909 | Smallwood | 432/232 |
| 1,434,207 | 10/1922 | Harris | 432/230 |
| 2,433,055 | 12/1947 | Linden et al. | 432/225 |
| 2,634,633 | 4/1953 | Smith | 432/225 |
| 3,113,012 | 12/1963 | Smith | 65/152 |
| 3,279,701 | 10/1966 | Falk et al. | 239/413 |
| 3,706,824 | 12/1972 | Huber et al. | 126/271.2 C |
| 3,776,689 | 12/1973 | Mayo et al. | 126/271.2 |
| 3,816,065 | 6/1974 | Marietta | 432/183 |
| 4,449,925 | 5/1984 | Williams et al. | 126/413 X |
| 4,567,676 | 2/1986 | Conti | 432/225 X |
| 5,178,535 | 1/1993 | Delalle | 431/350 X |

OTHER PUBLICATIONS

Uniweld Products, Inc.–p. 24–"Acetylene/Air Stand and Specialty Tips".

"The Little Torch"–p. 5 (no date).

Smiths–p. 12–"Special Purposes Tips" (no date).

*Primary Examiner*—Larry Jones

*Attorney, Agent, or Firm*—Malcolm Reid

[57] ABSTRACT

The oxygen-fuel torch includes a torch body having fuel gas and oxygen conduits for conducting the respective gas to the torch head and therethrough to a torch tip. The torch tip is connected through an adaptor to the torch head and includes an elongated tip stem that is joined to an arcuately curved tip head. The tip head extends angularly through an angle of at least about 245 degrees and has three outlet orifices opening toward a common point to direct three flames to substantially surround tubing for soldering or otherwise heating. If three orifices are provided, the orifices are angularly spaced about 120 degrees from one another.

12 Claims, 2 Drawing Sheets

MULTIPLE FLAME TORCH APPARATUS

BACKGROUND OF THE INVENTION

This invention relates to a torch that is especially adapted for use in heating and soldering operations in very tight spaces, for example heating pipes or other tubular members and more particularly to the torch tip used with a torch body.

Problems have been encountered in performing soldering or other heating operations, for example, in the installation and repair of air conditioning and refrigeration equipment. At times the repair has to be made wherein tubing is located in corners or other areas which are difficult to access with single or two flame torch tips or where the operator can not move to a position to see a part of the tubular member that is opposite the operator.

In order to overcome problems such as the above, this invention has been made.

SUMMARY OF THE INVENTION

The torch includes a torch body that mounts a torch tip having a tip stem mounted to the torch body and an arcuately shaped tip head that advantageously extends through an angle of about 245° to 280°. The head tip has a plurality of outlet orifices, advantageously three, that are substantial equally angularly spaced from one another and are inwardly directed to open toward a central location.

One of the objects of this invention is provide a new and novel torch apparatus for soldering pipes and the like, particularly such members that are located in cramped quarters. Another object of this invention is to provide a new and novel torch tip for heating substantially the entire outer peripheral surface of a tubular member at the same time, including the side that is not visible when in cramped quarters. A further object of this invention is to provide a new and novel torch tip to focus concentrated heat directly at a tubular metal member with minimal residual flame and to minimize the chance of burning surrounding components and cabinetry.

DESCRIPTION OF THE PREFERRED EMBODIMENT

Figure 3:
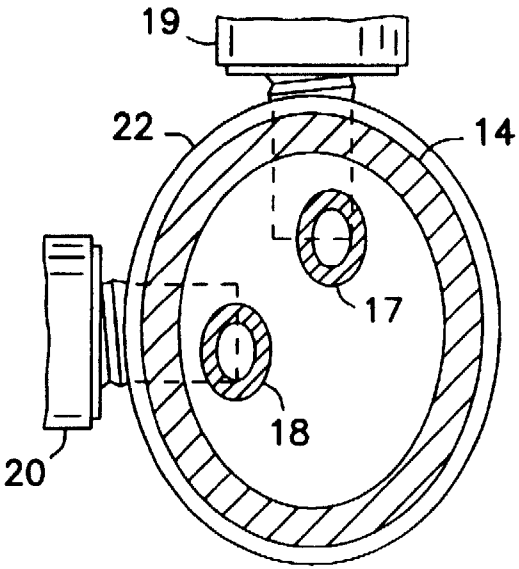
FIG. 3 is a transverse cross sectional view of the torch that is generally taken along the line and in the direction of the arrows 3—3 of FIG. 2.

Referring to the drawings, the torch body, generally designated 11, includes a longitudinally elongated tubular handle or housing 14 which at its rear end mounts a torch butt 13 and at its opposite rear end mounts a torch head 12. Mounted to the torch butt and torch head are a fuel gas conduit 17 and an air or oxygen conduit 18 to extend within the housing 12 and rearwardly of the torch butt. Hoses 28, 29 are connectable to the rear ends of the conduits 17, 18 for fluidly connecting the conduits to sources of supply (not shown) of pressurized fuel gas (for example acetylene) and oxygen (or air) respectively.

A fuel gas control valve assembly 19 is mounted to the torch head for adjustably controlling the flow of fuel gas from the conduit 17 to the inlet end of the fuel gas passageway 22 in the head 12 and through the fuel gas passageway 22 to the head bore 24 in a conventional manner. Similarly, an oxygen control valve assembly 20 is mounted to the torch head for adjustably controlling the flow of oxygen from the conduit 18 to the inlet end of the oxygen passageway 23 in the head 12 and through the oxygen passageway and to the head bore 24 in a conventional manner. A nozzle 25 is provided in the head bore 24 to have oxygen and fuel gas from the passages 23, 22 flow therethrough to the tip adaptor 27 which is threaded in the front end of the head bore. Since the structure of the torch body may be the same as that described in U.S. Pat. No. 3,279,701 to Falk et al which is incorporated herein by reference, for the most part the structure of the torch body 11 will not be further described. However, it is to be understood that other conventional torch bodies can be used in conjunction with the torch tip, generally designated 10, of this invention.

The torch tip 10 includes a longitudinally elongated tubular stem 30 which at its rear end mounts a compression sleeve 31 that is abutable against the wall defining the front end portion of the adaptor bore 32. A nut 33 is provided on the tubular stem for being threaded to the tip adaptor to retain the compression sleeve in abutting relationship to the tip adaptor in the desired angular relationship with the adaptor bore in fluid communication with the stem bore 34. By loosening the nut, the torch tip can be rotated relative to the tip adaptor about the central axis C—C of the tip stem 30 and then retained in the adjusted rotated position by tightening the tip nut.

The torch tip also includes a tip head 37 which is arcuately curved through an angle of at least about 240° and advantageously about 245° to 280°. Advantageously, as seen from the side (FIG. 2), the tip head is arcuately curved (nearly circumferentially) throughout its arcuate length. The tip head along its arcuate length is tubular from closely adjacent to one closed terminal end 38 to closely adjacent to its angularly opposite closed terminal end 39, and in transverse cross section may be circular. Further, the tip head has a plurality of outlet orifices open to passage 40 and toward a common point 45, preferably there being three orifices 41, 42, 43 respectively with orifice 41 being closely adjacent to tip end 38 and orifice 43 closely adjacent to tip end 39. For convenience, the surface 40B through which the orifices open toward point 45 will be referred to as the "angularly inner peripheral" surface in that it is most closely adjacent to point 45 while the opposite surface 40A will be referred to as the "angularly outer peripheral" surface. If the tip has three orifices, the orifices are advantageously spaced from one another by an angle of at least about 100° and preferably the orifices are equally angularly spaced (120° relative to one another) relative to point 45 and of the same linear spacing from said point. However, if more than three orifices are provided, the angular spacing would be less, but it would be desirable that the angular spacing be equal other than between the two orifices that are most closely adjacent to adjacent the tip head closed ends. The tip stem is joined to the outer peripheral surface of the tip head to have the stem passage outlet end open to the head passageway 40. With a three orifice tip 10, advantageously the central axis C—C of the tip stem intersects the tip head about midway angularly between orifices 42, 43 and also intersects orifice 41 or extends very closely adjacent thereto. Further, the axis C—C passes through or is very closely adjacent to the point 45.

The torch tip is made of a rigid metal that retains it shape during normal use. Advantageously the tip stem is made of stainless steel and the tip head is made of copper, the stainless steel stem providing the desired strength and isolating the head from the torch head and handle during operation. Further, the minimum linear spacing between the tip ends 38, 39 is larger than the outer diameter of the tubular member 47 or joint of two tubular sections that are to be joined, for example by soldering, or otherwise heated while performing a maintenance operation.

Figure 1:
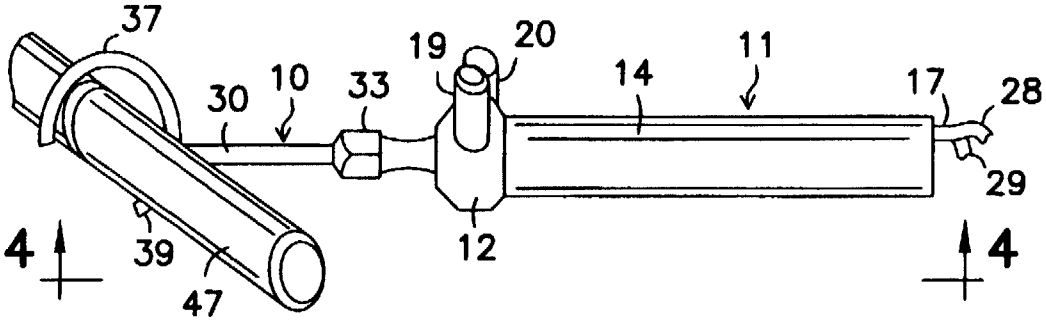
FIG. 1 is a somewhat perspective view of a torch with the tip of this invention in position for heating a metal tubular member.
Figure 4:
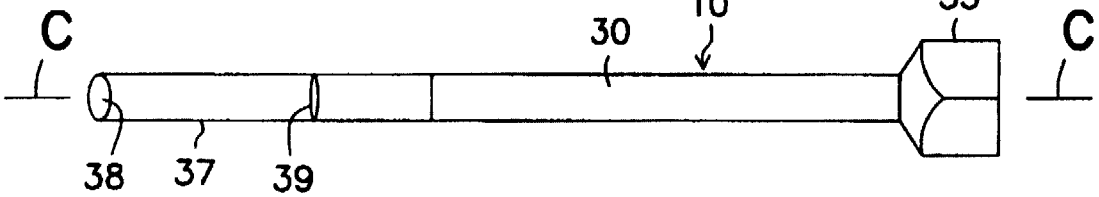
FIG. 4 is an end view of the torch tip that is generally taken along the line and in the direction of the arrows 4—4 of FIG. 1.
Figure 2:
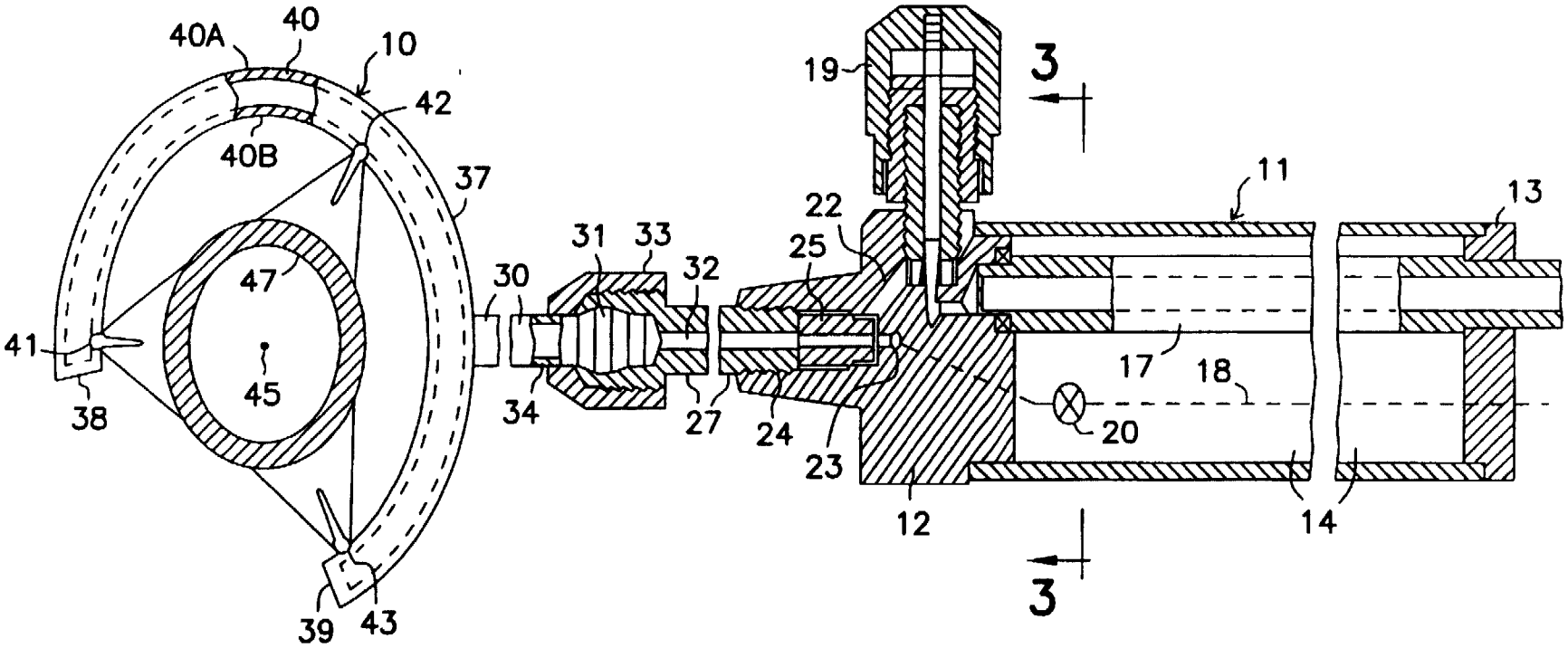
FIG. 2 is an enlarged longitudinal cross sectional view of a torch together with a side view of the torch tip heating a tubular member with longitudinal intermediate parts of the torch being broken away, the oxygen conduit and oxygen valve assembly being diagrammatically shown and a part of the tip head being shown in cross section.

In using the torch, it may be moved relative to the tubular member 47 that is to be soldered or otherwise heated such that the tip head ends 38, 39 pass on diametrically opposite sides of the tubular member to a position that the central axis of the tubular member (pipe) extends through or is closely adjacent to the common point 45 of the tip head such as shown in FIGS. 1 and 2. At this time, the tip provides three flames to substantially completely surround the tubing 47. In being used to solder two tubular sections together, the joint is heated evenly and minimizes cold spots, which in turn aids in providing complete and evenly soldered joints. The tip produces flames that converge directly on the tubular member and thereby makes efficient use of heat energy produced while there is minimal residual flame that could burn surrounding structure or components. Further, since the flames substantially surround the tubular member, the side of the tubular member opposite the operator can be easily heated even though the back side of the tubing is located in a corner or in other areas where it is difficult to access with single or two flame tips.

Even though the tip head has been described as having three orifices, it is to be understood it may be provided with more orifices that are substantially equally angularly spaced from one another along the head's arcuate length and of substantially the same linear spacing from a common point 45. Further, a conventional flexible tip extension may be connected between the tip and the tip adaptor.

As an example of the invention, but not otherwise as a limitation thereon, with a tip usable for soldering pipes of ¼ to ⅞ outer diameter, the minimum linear spacing of the tip head ends (gap) would be about 1 1/16 inches and the flame at each orifice would produce a flame at an angle away from the cutting plane of the circular section of the tip, at an angle of about 20 to 35 degrees. This keeps the flame from overheating the tip while it is soldering the pipe. The tip orifices are about 0.020 to 0.030 inches in diameter. For larger diameter tubes, there would be provided a tip head having its orifices at a greater minimum spacing from point 45 and advantageously would have more than three orifices, would be a greater arcuate length and a greater linear spacing between terminal ends 38, 39 than that used for soldering pipes of ⅞ inch outer diameters.

What is claimed is:

1. A torch comprising a torch head having an oxygen passageway and a fuel gas passageway formed therein, each passageway having an inlet, a torch handle connected to the torch head and having a fluid conduit for each passageway in fluid communication with the respective inlet, oxygen control means mountable on the torch head to extend into the oxygen passageway for selectively blocking the flow therethrough and adjustably controlling the rate of flow therethrough, fuel gas control means mountable on the torch head to extend into the fuel gas passageway for selectively blocking the flow therethrough and adjustably controlling the rate of flow therethrough, a torch tip, and means for attaching the torch tip to the torch head and cooperating with the torch head to place the torch tip in fluid communication with said fuel gas and oxygen passageways, said torch tip including a tip stem having an inlet end in fluid communication with said fuel gas and oxygen passageways and an outlet end and a tip head joined to the tip outlet end in fluid communication with the tip outlet end and extending angularly through an angle of at least about 240°, said tip head having at least a first, a second and a third outlet orifice, the orifices being angularly spaced from one another and opening toward a common point.

2. The torch of claim 1 wherein the orifices are spaced by an angle of at least 100°.

3. The torch of claim 1 wherein the outlet orifices are substantially equally angularly spaced from one another.

4. The torch of claim 1 wherein the tip head is of an elongated length, has opposite first and second closed ends and is arcuately curve along its length between its closed ends, the first orifice is located adjacent the tip head first end and the second orifice is located adjacent the tip head second end.

5. The torch of claim 4 wherein the third orifice is about midway angularly between the first and second orifices and is angularly spaced from each of the first and second orifices by an angle of about 120°.

6. The torch of claim 5 wherein each of the orifices is of substantially equal linear spacing from said point and the tip head extends arcuately through an angle of less than about 280°.

7. The torch of claim 6 wherein the tip head has an angularly inner peripheral surface having the orifices opening therethrough and an angularly outer peripheral surface more remote from said point than the angularly inner peripheral surface, the tip stem is joined to an angularly outer peripheral surface and has a central axis of elongation that extends through said point.

8. The torch of claim 7 wherein the tip stem is joined to the tip head angularly about midway between the first and the third orifices.

9. A torch tip adapted for use with a fuel gas torch to heat or solder a metal structure such as tubular members, comprising an elongated tip stem having an inlet end and an outlet end and an elongated tubular head arcuately curved about a common point and spaced therefrom, said tip head being of an arcuate length to extend angularly through an angle of at least about 245° relative to said point and having first and second closed ends and a fluid passageway extending between the closed ends, said tip head having an angularly inner peripheral surface and an angularly outer peripheral surface more remotely spaced from said point along its length than the angularly inner peripheral surface, said inner peripheral surface having several outlet orifice opening therethrough toward said common point and to the tip head passageway and being substantially equally angularly spaced from one another, the tip stem having a passageway extending from the stem inlet end and opening to the tip head passageway.

10. The torch tip of claim 9 wherein the orifices include a first orifice adjacent to the first head end, a second orifice adjacent to the second head end and a third orifice angularly about midway between the first and second orifices.

11. The torch tip of claim 10 wherein the tip stem has a central axis of elongation that extends through said point and extends angularly away from said point about midway between the first and third orifices.

12. The torch tip of claim 10 wherein the third orifice angularly is spaced about 120 degrees from each of the first and second orifices and the torch head extends angularly through an angle less than about 280°.

* * * * *